United States Patent [19]

Pippin, Jr.

[11] 3,962,818

[45] June 15, 1976

[54] REACTION TOY ARRANGEMENT AND METHOD

[76] Inventor: Reginald F. Pippin, Jr., 7806 Ruxway Road, Towson, Md. 21204

[22] Filed: June 22, 1972

[21] Appl. No.: 265,283

Related U.S. Application Data

[62] Division of Ser. No. 102,294, Dec. 29, 1970, Pat. No. 3,683,544, which is a division of Ser. No. 504,300, Oct. 24, 1965, Pat. No. 3,550,313.

[52] U.S. Cl. ..... 46/74 D

[51] Int. Cl.[2] ..... A63H 27/100

[58] Field of Search ..... 46/74 R, 74 C; 244/1, 244/74

[56] References Cited

UNITED STATES PATENTS

| | | | |
|---|---|---|---|
| 3,046,694 | 7/1962 | Holderer | 46/74 C |
| 3,049,832 | 8/1962 | Joffe | 46/74 C |
| 3,091,052 | 5/1963 | Ryan | 46/74 C |
| 3,174,501 | 3/1965 | De See | 273/58 |
| 3,550,313 | 12/1970 | Pippin | 46/74 R |
| 3,785,083 | 1/1974 | Pippin | 46/74 C |

*Primary Examiner*—Louis G. Mancene
*Assistant Examiner*—Robert F. Cutting

[57] ABSTRACT

A fluid discharge reaction-propelled toy missile arrangement capable of formation in multiple stages or units releasably interconnected as a function of internal propulsive pressure in the succeeding stages or units, or capable of individual unit single stage use, if desired. A self-sealing lateral inlet valve separate and spaced from the fluid discharge propulsion orifice of an individual missile unit enables individual unit pressurization from an external fluid pressure source. Missiles are launched from a ground-launching unit which may have a fluid pressurizing inlet and a fluid pressurizable releasable missile-holding connection, or may have other releasable missile-holding connection, and launch simulation enhancement can be provided, if desired, by controlled-release lateral liquid spray from one or more discharge orifices in the launching unit and separate from the fluid pressurizing inlet therefor.

43 Claims, 9 Drawing Figures

REACTION TOY ARRANGEMENT AND METHOD

This is a division of co-pending application Ser. No. 102,294, filed Dec. 29, 1970, now U.S. Pat. No. 3,683,544, Aug. 15, 1972, which in turn is a division of application Ser. No. 504,300, filed Oct. 24, 1965, now U.S. Pat. No. 3,550,313, dated Dec. 29, 1970.

This invention relates to a reaction toy arrangement and method, and more particularly to a fluid expulsion type reaction motor missile arrangement.

It is a feature of the invention to provide a fluid pressurizable discharge propulsion missile in which the fluid pressure is applied through a pressurizing valve spaced from the fluid discharge propulsion orifice of the missile, the pressurizing valve being preferably self-closing and disposed in a side wall of the missile.

Still a further feature is the provision of a multistage-toy interconnection arrangement in which the various stages are hermetically sealed from one another.

Another feature is the provision of an externally fluid pressurizable discharge propulsion toy missile unit, launchable singly or in multiple stage combination, in which fluid pressurization is accomplished from an external self-sealing valve connecting between the exterior of the missile unit and an internal fluid chamber which also is in open fluid connection to the fluid discharge propulsion orifice of the missile unit.

A further feature is the provision of a toy missile arrangement having multiple fluid pressurizable units with releasably closable respective fluid discharge orifices, and at least one of the units being pressurizable from a source of fluid under pressure through an inlet passageway separate from its fluid discharge orifice.

Another feature is the provision of a toy missile arrangement having multiple units, at least one of which units is internally fluid pressurizable for self-propulsion and has a fluid inlet passageway separate from a fluid discharge propulsion orifice therein, for passage of fluid under pressure into said one unit preparatory to self-propulsion by discharge of fluid under pressure from said discharge propulsion orifice.

Another feature is the provision of a toy missile arrangement having a self-propelled unit which is propelled by fluid discharge from a discharge propulsion orifice therein, which unit has a fluid inlet passageway for fluid pressurization of such unit, and which fluid inlet passageway is separate from and additional to the fluid discharge propulsion orifice of the unit.

Still a further feature is the provision of a facile and a desirable method of pressurizing from an external pressure source, a fluid-discharge-propellable missile unit or units having a discharge propulsion orifice, and by which method the externally derived pressurization is accomplished through an opening, preferably self-closing, other than the discharge propulsion orifice of a given missile unit.

Still other objects, features and attendant advantages will become apparent to one skilled in the art from a reading of the following detailed description of several physical embodiments constructed in accordance with the invention, taken in conjunction with the accompanying drawings wherein.

Figure 1:
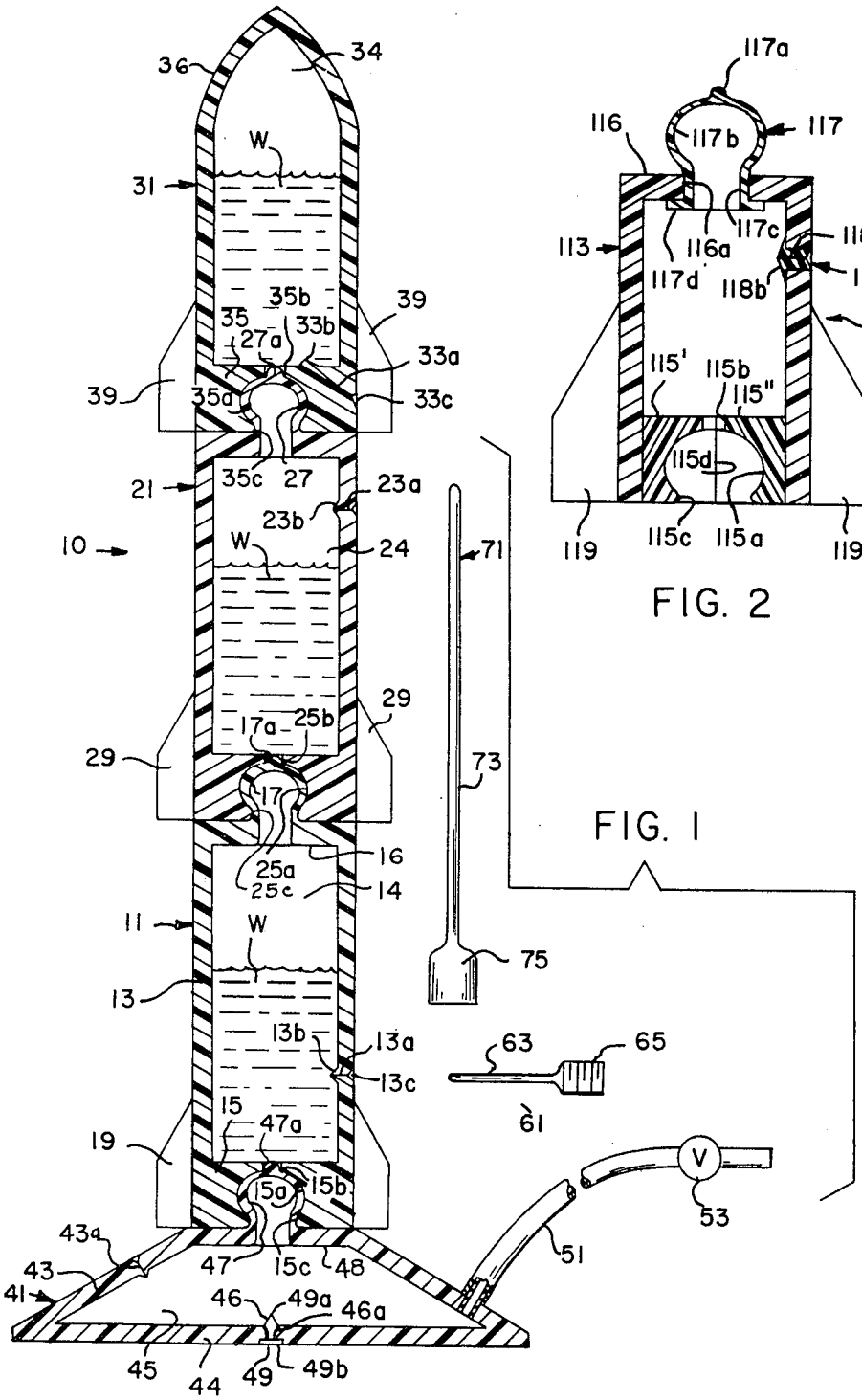
FIG. 1 is a longitudinal section view of a multistage rocket toy according to the invention.

Referring now to the figures of the drawings, in FIG. 1 is shown a multistage rocket toy 10 which in the present embodiment incorporates three stages, although it will become apparent that with the present invention the number of stages is virtually unlimited within the propulsion capabilities of the given rocket size, being for example one, two, three, or more, stages. The illustrative rocket 10 includes three self-separable stages 11, 21, 31, the lowermost or first stage 11 being releasably mounted on a launching pad 41 having a remote control pressure release launch-control valve 53 connected thereto through a hollow conduit 51.

Each separable stage or section 11, 21 and 31 includes a cylindrical body having a pressurizable liquid storage chamber 14, 24 and 34 respectively, enclosed by an annular side wall 13, 23, 33 respectively, and front and rear end walls 15, 16; 25, 26; and 35, 36, respectively. Stabilizing fins 19, 29, 39 are formed or secured on the outer surface of the respective stage sections 11, 21 and 31, and the final or upper stage 31 has a tapered or ogive shaped end 36 for decrease of air resistance during flight.

The forward end walls 16 and 26 of the first and second or penultimate stage sections 11 and 21 have a pressure-sensitive laterally flexible diaphragm wall male connector-seal in the illustrative form of a bulbous flexible nose protrusion 17, 27, respectively, which is as a function of pressure in the respective liquid storage chamber 14, 24, pressurizable for rigidizing thereof and depressurizable for ease of flexing and discharge thereof from a respective female connection 25*a*, 25*b*, 25*c;* and 35*a*, 35*b*, 35*c* in the adjoining next forward stage 21 and 31 respectively. Each bulbous nose protrusion 17, 27 includes a unitary relatively thin-walled integral diaphragm-like body structure having an intermediate enlarged annulus portion disposed between a smaller tip protrusion and a smaller annular portion adjacent the root end. The bulbous nose protrusions serve as pressure-responsive connector seals which lockingly engage and seal the respective female connecting and fluid discharge or expulsion openings 25*a*, 25*b*, 25*c;* and 35*a*, 35*b*, 35*c*. In the illustrative embodiment, each female connecting and fluid discharge or expulsion opening includes an intermediate annular groove portion 25*a*, 35*a* disposed between a relatively smaller diameter liquid discharge metering orifice 25*b*, 35*b* and a reduced diameter smoothly rounded rim portion 25*c*, 35*c*. The flexible bulb connector-seals 17, 27 are preferably shaped to be generally complementary to the respective mating female openings, although it will be appreciated that differences in shape and size may be accommodated to a degree dependent upon the elasticity of the material forming the bulb-connector seals, in which event when the seal integrity and connection strength are effectively maintained the effective pressurized joint is therefore formed of effectively substantially complementary relation. Some degree of pressure-responsive distension is present in all materials, and the extent of distension employed, if any, will depend upon the extent of manufacturing or design mismating and the elastic distension capabilities of the material forming the bulb protrusions.

While the term "bulbous" or "bulb" as applied to pressurizable laterally flexible wall connector elements 17, 27, etc., describes in one restricted sense the specific shape of a male shaped connector having an enlarged mid-section, its primary meaning and scope as used herein lies in and encompasses the generic structural and action sense and meaning of a male shaped connector member generally which is capable of lateral swelling, and in each instance having an internal pressure responsive laterally flexible wall section which is pressurizable when in place within a fluid discharge orifice to afford pressure responsively releasable holding action therewith. The fluid-pressure-responsive laterally flexible diaphragm wall connector elements or members 17, 27, etc., may, of course, be formed with other configurations and constructions than the illustrated and preferred bulbous configurations and constructions.

Launching pad 41 is pressure-responsively connected to the female connecting and fluid discharge openings 15*a*, 15*b*, 15*c* of the first stage section 11 through the medium of a flexible bulb connector-seal 47 similar to interstage flexible bulb connector-seals 17 and 27.

Although the pressurizing of the various chambers 14, 24, 34 and 45 will tend to properly seat the preinserted bulb connector-seals in their respective female openings it may be advantageous and desirable in some instances, particularly in the case of highly flexible bulb connector-seal embodiments to employ a connector bulb insertion aid 71 which may take the form of a rod 73 having a handle 75. The rod 71 may be inserted through the female fluid discharge opening 15*b*, 25*b* of a particular rocket section to push on and effect manipulation of the respective bulb connection-seal 17 or 27 into its corresponding adjoining next stage complementary female opening 25*a*, 25*b*, 25*c* or 35*a*, 35*b*, 35*c* as the case may be. To enable use of insertion aid 71 with the interconnection between launcher pad 41 and the first stage section 11, the bottom wall 44 of pad 41 may be provided with a central removable plug 49 aligned with bulb connector-seal 47. Plug 49 may be formed with a douple tapered nodule detent 49*a* for ease of insertion and removal and a recessed flat head 49*b*.

The rocket stage sections 11, 21 and 31 and a launching pad 41 are each provided with a self-closing valve 13*a*, 23*a*, 33*a* and 43*a*, respectively, to enable pressurizing of the respective chambers 14, 24, 34 and 45, after assembly of respective adjoining stages, although the launch pad chamber 45 may if desired be pressurized through valve 53 and conduit 51. Each of the self-closing valves includes pressure-responsive self-obturating inner closure lips 13*b*, 23*b*, 33*b*, and 43*b* respectively and a flared outer guide opening as indicated at 13*c* may also be provided if desired. For purposes of illustration of differing locations for the valves, each of the valves 13*a*, 23*a*, 33*a* is shown at a different location on its respective rocket stage section, although it will be appreciated that for a given assembly all valve openings 13*a*, 23*a* and 33*a* would normally lie in the same general position on the respective different stage sections. A conventional valve needle 61 of the type commonly employed for inflating footballs, basketballs, etc., and a conventional air pump (not shown) may be used in conjunction with valve 13*a*, 23*a*, 33*a*, and 43*a* to effect pressurizing of the respective chambers 14, 24, 34 and 45.

It will be appreciated that inasmuch as the illustrated first and second stages 11 and 21 are interchangeable, it is a simple matter to reduce the number of stages to two or one by elimination of one or both of stages 11 and 21, and to increase the number of stages as desired by adding additional stages identical to either stage 11 or 21.

As an example of assembly and launching of the rocket 10, water is added to partially fill first stage storage chamber 14 as by pouring into the effective funnel-mouthed opening 15*a*, 15*b*, 15*c* while the section 11 is inverted, and launching pad 41 is thereupon mated with section 11. While retaining the assembly 11, 41 in inverted position, the chamber 45 is pressurized through valve opening 43*a* or through line 51 to effect secure retaining connection and sealing of the launching pad 41 to the first stage 11 through pressure-responsive bulb and socket connection 47, 15*a*, 15*b*, 15*c*. Thereupon, water is added to partially fill storage chamber 24 in second stage section 21 while holding the second stage in inverted position, and the first stage bulb connector-seal is then inserted into the opening 25*a*, 25*b*, 25*c*, after which the first stage chamber 14 is pressurized through valve opening 13*a* to lock sections 21 to first stage section 11 and the assembly 11, 41. This same operation is then repeated for partial filling of third stage section 31, connection thereof to second stage section 21, and subsequent pressurizing of second stage 21 through valve opening 23*a* to lock sections 21 and 31 together. The assembly operation is then completed by pressurizing final stage chamber 34 through valve opening 33*a*, and the assembly is then ready for launch.

The foregoing method of assembly is most advantageous when the bulb connector-seals 17 et al. are of sufficient rigidity to enable flexing insertion without the aid of tool 71, as only two pieces need be held together at a time in unsecured connected condition. However when it is necessary or desired to employ the insertion aid tool 71 on all interstage connections, a different assembly procedure may be employed. In this instance the final stage section 31 is first partially filled with water while inverted and thereupon the second stage section 21 is connected thereto by inserting the bulb connector-seal 27 into the opening 35*a*, 35*b*, 35*c*, using the tool 71 through second stage opening 25*a*, 25*b*, 25*c* to aid in this assembly. Water is then added through opening 25*a*, 25*b*, 25*c* to partially fill second stage 21, and first stage 11 is connected to stage 21 through insertion of bulb connector-seal 17 into opening 25*a*, 25*b*, 25*c*, using tool 71 through opening 15*a*, 15*b*, 15*c*. Water is then added to partially fill the storage chamber 14 of the first stage 11 while continuing to hold the assembly 11, 21, 31 in inverted vertical position, and the launch pad 41 is then connected by removing the plug 49 and manipulating the tool through opening 46 to aid in positioning the bulb connector-seal within the mating connecting and fluid discharge opening 15*a*, 15*b*, 15*c* of the first stage section 11. Plug 49 is then replaced, and thereupon launching pad chamber 44 is pressurized through either valve opening 43 or conduit 51 and valve 53. This secures first stage 11 and launch pad 41 together in sealed relation and chamber 14 is thereupon pressurized through valve opening 13*a* to secure stages 11 and 21 together, whereupon second stage 21 is then pressurized through valve opening 23*a* to lock and seal stages 21 and 31 together, and final stage chamber 34 is then pressurized through valve opening 33*c* to ready the assembly for launching. It will be appreciated that in this last described method of assembly a holding jig or fixture may be used if desired to retain the various sections in position during assembly, although such may be accomplished by hand only if desired, particularly with the aid of a second person.

To launch the rocket 11 from the launch pad 41, the assembly 41, 11, 21, 31 is turned to a vertically upright position as shown in FIG. 1, and valve 53 is released to release the pressure within chamber 45. The pressure withn chamber 14 of first stage 11 will then cause the flexible bulb connector-seal to laterally collapse and be ejected from the opening 15*a*, 15*b*, 15*c* and liftoff will occur with the subsequent continuing discharge of liquid through metering orifice 15*b*. The rocket assembly will continue upward under the reaction force influence of the ejected water mass from orifice 15*b* until the pressure in chamber 14 drops sufficiently to enable the then greater pressure within chamber 24 (which was initially approximately similar to that of adjacent chambers 14 and 34), to overcome the holding action of bulb connector-seal 27 in opening 25*a*, 25*b*, 25*c*. Upon reaching this pressure difference the second and third section assembly will then separate from the first stage in a manner similar to that of first stage 11 and launch pad 41. The second and third stage assembly 21, 31 will continue upward together until a similar pressure differential separation occurs between these two stages, and the third stage will thereupon continue upward alone under its own reaction motor thrust power through liquid ejection from metering orifice 35*b*. Upon exhaustion of the liquid from each of the stages to thrust will quickly drop to zero and the stage will thereafter drop to the launch area. Upon recovery of all stages the rocket 11 may be reassembled together with launch pad 41 and launched again.

Figure 2:
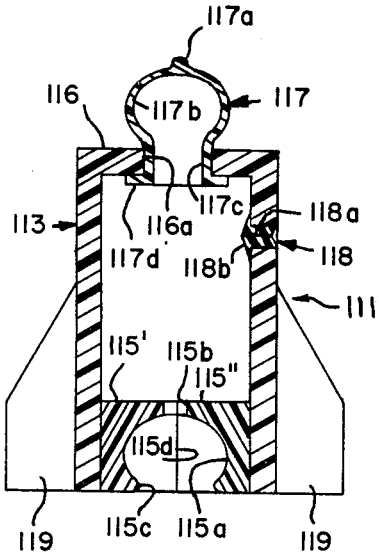
FIG. 2 is a longitudinal section view of a rocket stage modified for ease of molding manufacture.

For ease of manufacturing the various stages and the launcher may take various forms. For instance, as shown in FIG. 2, illustrating a modified construction of rocket stage section 111, the body 111 may be formed in several pieces which are then suitably bonded together to form the unitary body. In this modified embodiment the rear end wall is formed separately from the side and forward wall section 113, 116, as is the self-sealing valve 118 and the bulb connector-seal 117. The rear end wall is formed as two or more split laterally mating sections 115′, 115″, each having a concavo-concave intermediate groove surface 115*a*, samll diameter concavo-convex metering orifice surface 115*b* and reduced diameter neck rim surface 115*c*. With this construction the separately formed pieces may be formed of different materials consistent with their required function. For instance, the bulb connector-seal 117 may be formed of softer more elastic material than body 113, as may self-sealing valve 118. Bulb connector-seal 117 is secured to the main body 113 through bonding of an intermediate neck portion 117*c* and flange retaining portion 117*d* to the adjoining area surrounding opening 116 in end wall 116. Valve 118, which is preferably of soft pliant rubber, is inserted through an opening in side wall 113 and is bonded thereto and/or held in place by tight friction fit which aids in assuring normally self-sealing of the opening 118*a*. In addition it may be noted that each of the valve openings 118*a*, 18*a*, etc., of the various valves may be formed by puncturing with a sharp small diameter needle, or by other conventionally practiced self-closing valve construction techniques. Further, various other valve constructions may be employed for the valves 118, 18*a*, etc., as desired, it being desirable however that the valves be normally self-closed in the discharge directions.

Figure 3:
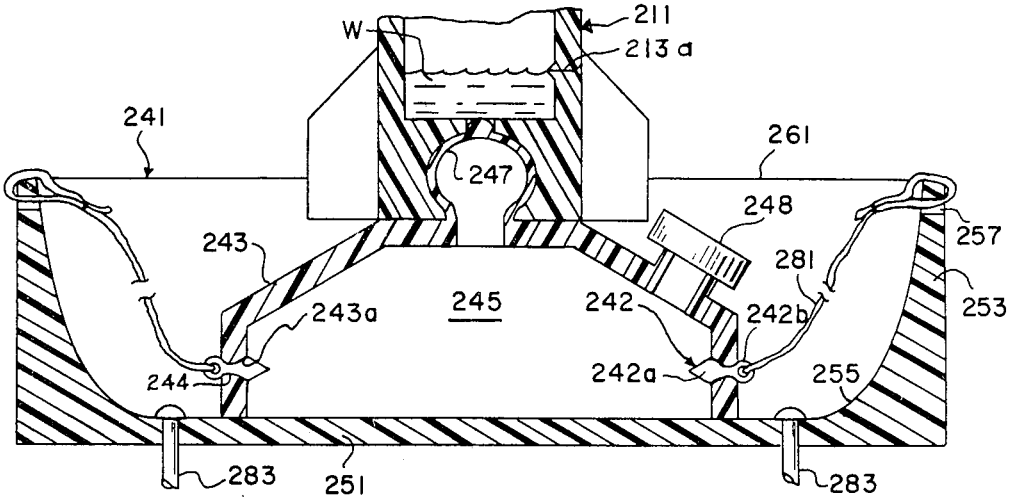
FIG. 3 is a fragmentary view of a modified launcher and rocket arrrangement.

FIG. 3 illustrates a modified launch pad arrangement which provides added simulated realism to the launching operation. In this modified embodiment the housing 243 for the pressurizable fluid chamber 245 of the launch pad 241 has radially extending liquid discharge orifices 244 formed at circumferentially spaced positions about the annular periphery thereof. The orifices 244 preferably have a flared inner seat end and are releasably closed by substantially complementary pressure releasable plugs 242, each having a double tapered retention nodule end 242*a* seating on seat 244*a*. The plugs 242 are preferably additionally connected for safety and retention purposes to the launch pad 241 through the medium of a flexible cord or other flexible line 281 secured through spaced eyes 257 formed in the annular outer upstanding rim 253.

The launch pad 241 may be secured to the ground for stability, if desired, as with anchor pins 283 extending through the base 251 thereof. While not shown, a tool receiving opening and a removable plug may be provided in the bottom 251 of launch pad 241 as in FIG. 1 if so desired, it being preferred in such cases that the removable tool assistance plug be constructed and shaped for substantially more difficult removal than the plugs 242 so as to prevent undesired removal of the plugs during operation of the launch pad 241.

A female water hose connection is provided in the wall 243 as indicated at 248 for supply of water to and pressurizing of the chamber 245. Annulus wall 253 has an upwardly concavely curved surface 255 in the path of discharge from the orifices 244 and this surface 255 serves to deflect and disperse water from the orifices 244 upwardly.

In operation of the embodiment of FIG. 3, a rocket 211 partially filled with water is connected to launch pad 241 through insertion of bulb connector-seal 247 in the associated rear discharge and connection opening of the rocket body. Water is then added to chamber 245 through a hose (not shown) connected to hose connector 248 sufficient to pressurize the bulb 247 to operational sealing and holding condition, but insufficient to effect discharge of said plugs 242 from their orifices 244. The rocket 211 is then pressurized through its associated valve 213*a*, whereupon the water pressure is increased within chamber 245 by remote control from a conventional water faucet supply connection (not shown) to effect discharge of the plugs 242 and resulting spraying of water through the orifices 244. The radial jets of water will be deflected and dispersed upwardly in a generally ring-shaped pattern, the continuity of which is dependent to a degree upon the number of spacing of orifices 244. With a sufficient quantity and size of orifices in comparison to the available water flow rate into chamber 245, the resulting pressure drop will be sufficient to enable launching of rocket 211. However, launching can be assured by turning the faucet full open to eject the plugs 242 and effect the desired water spray action, and thereupon turning off the faucet, as the pressure in the chamber 245 will in the final condition be reduced to zero, assuring release and lift-off of the rocket 211 from launch pad 241.

Figure 4:
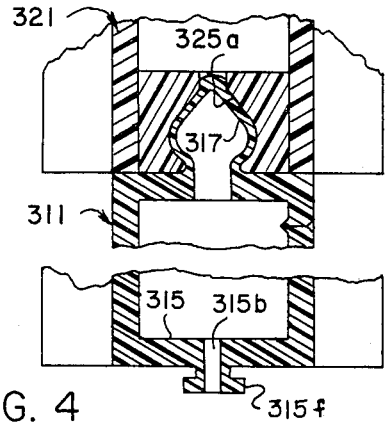
FIG. 4 is a longitudinal section view of a further modified first stage rocket section.
Figure 5:
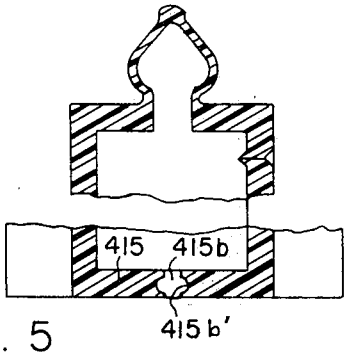
FIG. 5 is a longitudinal section view of an additional modified first stage rocket section.

In FIGS. 4 and 5 are shown two permissible, though to some degree less advantageous, modifications of first stage sections of a multistage rocket according to the invention. In each instance the stage section incorporates a pressurizable flexible bulb connector-seal 317 for connection of two adjoining first and second stages 311 and 321, the bulb connector-seal 317 being of tear-drop shape for each of insertion and relatively greater resistance to removal. This facet is considered desirable in various instances for all stage bulb connector-seals, the somewhat less advantageous construction lying in the alternative constructions for connection to the launcher. In FIG. 4 the launcher connection is a flanged nozzle 315*f* formed on rear wall 315 and having a fluid discharge orifice 315*b*. With this construction the rocket 311 may be launched with the aid of a mechanical slide release launcher such as shown on U.S. Pat. No. 2,732,657. The discharge orifice 315*b* in the embodiment of FIG. 5 has a shallow small diameter annular groove 415*b'* formed in the discharge orifice 415*b* and is adapted to be launched with the aid of a nodular stemmed launcher as provided in U.S. Pat. No. 3,046,694. Various other hybrid stage sections may be employed as desired, though such are generally considered less desirable than the arrangement in which all stages and the launch pad are connected and separated in a similar manner.

Figure 6:
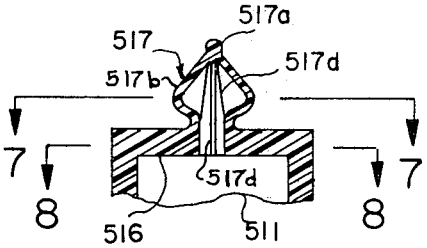
FIG. 6 is a fragmentary longitudinal section view of a modified fluid-pressure-responsive bulb connector-seal arrangement.
Figure 8:
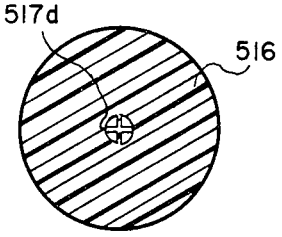
FIG. 8 is a section view taken on line 8—8 of FIG. 6.
Figure 7:
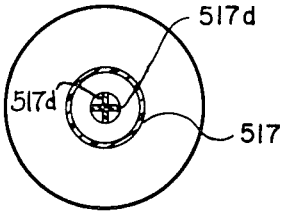
FIG. 7 is a section view taken on line 7—7 of FIG. 6.

A modified bulb connector-seal 517 is shown in the rocket section embodiment 511 of FIGS. 6–8, wherein the bulb wall 517*b* has a tear-drop shape for relative ease of insertion in comparison to removal of the bulb connector-seal from its complementary female opening, and in which the bulb is longitudinally reinforced while providing collapsibly lateral flexibility of the wall 517*b*. This is effected by a longitudinal reinforcing rib unit having ribs 517*d* integrally connecting, or secured to, the tip and root end portions of bulb connector-seal 517 while being in disconnection therefrom in the intermediate enlarged girth flexible annular wall portion 517*b*.

Figure 9:
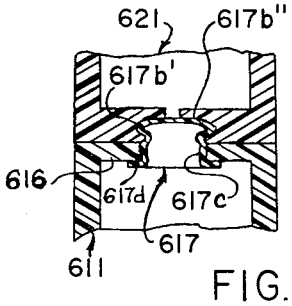
FIG. 9 is a fragmentary longitudinal section view of a further connector-seal arrangement modification.

FIG. 9 shows a further modified form of flexible bulb connector-seal 617 having a generally squat shape with a relatively large diameter securing rim annular portion 617*b'* compared to the depth thereof and a relatively flattened flexible outer end surface 617*b''*. The opening in wall 616 of rocket stage section 611 is relatively large so as to enable downwardly and inwardly rolling deflection and release of the retaining rim annulus portion 617*b'* from its complementary retention groove in response to decrease in pressure in the connecting liquid storage chamber of stage section 611. In this embodiment, as in FIG. 2, the bulb connector-seal 617 is formed separately from the main body of the associated rocket stage section 611, and is bonded thereto along retaining flange 617*d* and intermediate reduced diameter portion 617*c*, although in some instances it may be sufficient to bond only along flange 617*d*, in which latter instance the downwardly and inwardly rolling action of the bulb diaphragm connector-seal 617 may extend over a greater distance during stage separation.

While the invention has been illustrated and described with respect to various illustrative embodiments, various modifications and improvements may be made. For instance, the liquid and/or other desired fluid inserted in any one or more of the missile units and/or launcher unit may be inserted through the pressurizing valve for the particular unit, as in the pressurized loading of the launcher unit, in lieu of being loaded through the unit discharge orifice or separate launcher fill line or orifice. In addition, in a further modification or improvement, pressurizable flexible wall female inter-unit connectors may be employed in lieu of the illustrated pressurizable male connectors, in which instance the female connector may envelope and releasably engage in peripherally sealing relation a projecting rear section of a next succeeding missle unit or stage, which projecting section may include the discharge orifice section of such next succeeding unit, and thereby effectively closing such discharge orifice of the next succeeding unit during pressurized holding of such unit by the female connector. Also, the spray launcher may be provided with positive orifice-opening-and-missle-release-effecting means, such as a selectively longitudinally movable common release ring in releasable closure-controlling direct or indirect connection with a plurality of initially closed spray orifices, in lieu of the pressure responsively self-releasable multiple plug spray launcher as illustrated in FIG. 3. Accordingly, it is to be understood that the invention is not to be limited by the illustrative embodiments, but only by the scope of the appended Claims.

That which is claimed is:

1. A jet-propelled toy comprising a plurality of individual interconnectable separable units, one of said units having a pressurizable fluid storage chamber and a directionally stable jet propulsion fluid expulsion orifice in fluid connection between said storage chamber and the atmosphere, and a normally self-closed, fluid-pressure-containing, fluid passage valve in the body of said one unit at other than said fluid expulsion orifice for fluid passage connection between said pressurizable fluid storage chamber and a zone exterior of said one unit when said normally self-closed valve is opened.

2. A jet-propelled toy comprising a plurality of individual self-separable stages, said stages being interconnected, each of said stages having a pressurizable fluid storage chamber and a fluid expulsion orifice in fluid connection between said storage chamber and the atmosphere, said chambers being in permanent fluid disconnection from one another at the zone of interconnection thereof, said stages being connected at and in sealing relation to said fluid expulsion orifice of one of said stages, said one stage having a sealable pressurizing enabling means in the body thereof and disposed at other than said fluid expulsion orifice for pressurizing said one stage.

3. A jet-propelled toy according to claim 2, said sealable pressurizing enabling means being a self-sealing valve.

4. A jet-propelled toy according to claim 1, two of said units being separably interconnected through a fluid-sealed fluid-pressure-sensitive connection formed or secured on one of said units and connecting with an adjoining other of said stages.

5. A jet-propelled toy according to claim 4, said units being at least three in number, each of said stages being interconnected through a fluid-sealed fluid-pressure-sensitive connection according to claim 4.

6. A jet propulsion toy comprising a body having a pressurizable fluid chamber and closable fluid jet propulsion discharge orifice connecting between said chamber and the outside atmosphere, and a fluid pressurizing valve in said body and spaced from said jet propulsion discharge orifice.

7. A toy according to claim 5, said pressurizing valve comprising a soft elastic material having a normally self-closed elastic bore with an obturating self-sealing internal end surface.

8. A toy according to claim 6, said body having an elongate shape with said jet propulsion discharge orifice being disposed in one longitudinal end thereof, said pressurizing valve being disposed with its outer end extending through the longitudinally outer surface of said body.

9. A toy according to claim 8, said body having an interstage connector formed by an inflatably flexibly movable wall section adjacent the longitudinal end thereof opposite said jet discharge orifice end.

10. A jet propulsion toy arrangement according to claim 6, further comprising a second self-propelled body having a pressurizable fluid chamber and a fluid jet propulsion discharge orifice connecting between said chamber and the outside atmosphere, said second body being releasably connected to the first said body through fluid pressure responsive connecting and fluid sealing engagement with said propulsion discharge orifice of the first said body.

11. A jet propulsion toy arrangement according to claim 6, further comprising a second body as set forth in claim 6, said second body being releasably connected to said first body through a fluid-pressure-responsive releasable connection.

12. A jet propelled toy arrangement according to claim 11, further comprising a third self-propelled body as set forth in claim 11, said third body being releasably connected to said second body through a fluid-pressure-responsive connection.

13. A multi-unit toy missile arrangement, at least one unit thereof being individually self-propellable and having a respective pressurizable fluid chamber and associated fluid discharge orifice, at least one of said units having a body including a pressurizing enabling element as a part thereof and being other than a fluid discharge orifice, for pressurizing said one stage from an external fluid pressure source through insertion of fluid under pressure into said one unit.

14. The method of fuel loading and pressurizing two separable stages of a jet-propelled multistage missile comprising adding liquid to a liquid chamber within one of said stages, securing said stages together through a pressure-sensitive connection, adding liquid to the other of said stages and pressurizing said other stage while so connected to activate said pressure-sensitive connection and without pressurizing said one stage, and thereupon pressurizing said one stage through a lateral valve formed in the body of said one stage.

15. The method according to claim 14, further comprising loading with fuel and securing a third stage to said one of said two stages through a pressure-sensitive connection on said one stage and before pressurizing said one stage, and thereupon pressurizing said third stage through a lateral valve opening formed in the body thereof.

16. The method of fuel loading and pressurizing two separable stages of a jet-propelled multistage missile comprising adding liquid to a liquid chamber within one of said stages, securing said stages together through a pressure-sensitive connection, adding liquid to and pressurizing said other stage while so connected to activate said pressure-sensitive connection and without pressurizing said one stage, and thereupon pressurizing said one stage throught the body of said one stage and other than through said other stage.

17. The method of connecting and pressurizing two separable linearly connectible units of a jet-propelled missile arrangement, comprising securing said units together through a pressure-sensitive connection, pressurizing the rearmost of said two units while so connected, to activate said pressure-sensitive connection and without pressurizing the other said unit, and thereupon pressurizing the other said unit other than through said one unit.

18. The method according to claim 17, said units being sequential stages of a multi-stage missile.

19. The method of claim 17, said pressurizing of said other unit being effected through the body of said other unit and other than through said one unit.

20. The method of connecting and pressurizing two separable linearly connecting units of a jet-propelled missile arrangement, in which one of said units has a jet-propulsion fluid discharge orifice, comprising securing said units together through a pressure-sensitive connection, and pressurizing said one of said units through a valve spaced from said jet-propulsion fluid discharge orifice, to activate said pressure-sensitive connection.

21. The method according to claim 20, said one unit being the rearmost of said two units.

22. The method according to claim 20, said pressurizing being effected through a side wall valve.

23. The method according to claim 22, and self-sealing said valve after pressurizing therethrough.

24. The method according to claim 20, and self-sealing said valve after pressurizing therethrough.

25. The method according to claim 20, in which the other said unit is pressurizable and has a jet propulsion fluid discharge orifice, and thereupon pressurizing the other said unit other than through said one unit and other than through said jet propulsion fluid discharge orifice of said other unit.

26. The method according to claim 25, said pressurizing of said other unit being effected through a valve in said other unit and spaced from said jet propulsion fluid discharge orifice of said other unit.

27. The method of connecting and pressurizing two separable linearly connectible units of a jet-propelled missile arrangement, preparatory to launching, comprising securing said units together through a pressure-sensitive connection, pressurizing the rearmost of said two units while so connected, to activate said pressure-sensitive connection and without pressurizing the other said unit.

28. A self-propelled toy missile arrangement, comprising a plurality of separable units, one of said units being self-propelled and having a pressurizable fluid chamber and associated fluid discharge propulsion orifice, said one of said units having an individually pressurizing enabling valve therein disposed other than at its fluid discharge orifice and for pressurizing said one unit while said units are assembled.

29. A multiunit toy missile arrrangement according to claim 13, two of said units having a respective selectively closable fluid discharge orifice and an associated respective pressurizable fluid chamber.

30. A multiunit toy missile arrangement according to claim 29, said two units being individually self-propellable, said two respective fluid discharge orifices being selectively closable fluid discharge propulsion orifices.

31. A multiunit toy missile arrangement according to claim 13, at least two of said units being individually self-propellable and having selectively-closable fluid discharge propulsion orifices.

32. A self-propelled toy missile arrangement according to claim 28, said one unit having a pressurizable propulsion-discharge-fluid storage chamber in fluid connection between said pressurizing-enabling valve and said fluid discharge propulsion orifice, said fluid discharge propulsion orifice connecting with said chamber and disposed in said one unit for pressure-responsive propulsive discharge therethrough under the residual internal pressure of pressurized fluid contained in said pressurized fluid storage chamber.

33. A self-propelled jet propulsion unit comprising a spatially self-movable and -propelled jet propulsion body having a pressurizable propulsion-fluid storage chamber and a closable fluid jet propulsion discharge orifice connecting between said chamber and the outside atmosphere for propulsive discharge of pressurized fluid therefrom, and a fluid pressurizing valve in said body in fluid pressurizing connection with said pressurizable fluid chamber and spaced from said jet propulsion discharge orifice and in fluid flow communication therewith through said pressurizable fluid propulsion storage chamber, said self-propelled jet propulsion unit being self-propellable by force reaction to jet discharge of pressurizable fluid from said pressurizable fluid storage chamber and out through said jet propulsion discharge orifice in response to the internal fluid pressure of a quantity of pressurized fluid while in said pressurizable propulsion fluid storage chamber.

34. A self-propelled jet propulsion unit according to claim 33, said fluid pressurizing valve being a self-closing normally closed valve.

35. A self-propelled jet propulsion unit according to claim 33, said fluid pressurizing valve comprising a soft elastic material having a self-sealing normally self-closed bore.

36. A self-propelled jet propulsion unit according to claim 33, said body having an elongate shape, with said jet propulsion discharge orifice being disposed in one longitudinal end thereof, said pressurizing valve being disposed with its outer end extending through an outer surface of said body spaced longitudinally from said fluid jet propulsion discharge orifice.

37. A self-propelled jet propulsion unit according to claim 36, said body having an inter-unit connector formed by an inflatably flexibly movable wall section spaced longitudinally from said fluid jet propulsion discharge orifice and said valve.

38. A multi-unit toy missile arrangement, at least one unit thereof being individually self-propellable and having a respective pressurizable fluid chamber and associated fluid propulsion discharge orifice, said one individually self-propellable unit having a body including a pressurizing-enabling element as a part thereof and being other than a fluid propulsion discharge orifice, for pressurizing said one unit from an external fluid pressure source through insertion of non-combustibly fluid-pressure-responsively-jet-dischargeable fluid under pressure into said one unit for subsequent non-combustibly pressure-responsive jet propulsion discharge through said fluid propulsion discharge orifice.

39. The method of connecting and pressurizing two separable, connectible units of a jet-propelled missile arrangement, in which one of said units has a jet-propulsion fluid discharge orifice, comprising securing said units together through a pressure-sensitive connection, and pressurizing said one of said units having a jet propulsion fluid discharge orifice by injection of non-combustibly-pressure-responsively dischargeable jet propulsion fluid under pressure through a valve spaced from said jet propulsion fluid discharge orifice, to activate said pressure-sensitive connection, said non-combustibly jet propulsion dischargeable fluid being subsequently non-combustibly dischargeable through said jet propulsion discharge orifice in response to the residual pressure within said one unit after fluid-pressure connecting-actuation of said pressure-sensitive connection as a function of the injected fluid pressure.

40. A self-propelled jet propulsion unit comprising a spatially self-movable and -propelled jet propulsion body having a pressurizable propulsion-fluid storage chamber, with a closable fluid jet propulsion orifice connecting between said chamber and the outside atmosphere for propulsive discharge or pressurized fluid therefrom, and a normally self-closed pressurized-fluid-containment fluid passage valve in said body at other than said fluid jet propulsion orifice for fluid passage connection between said pressurizable propulsion-fluid storage chamber and a zone exterior of said body when said normally self-closed valve is opened.

41. A unit according to claim 40, said valve comprising an opening formed in a wall of said body at other than said fluid jet propulsion orifice and which wall bounds a portion of said chamber, and a normally self-sealed seal member secured across said opening and being formed of soft sealing material relative to the less yielding fluid-pressure-containment material of said body.

42. A unit according to claim 41, said valve seal member comprising an insert of soft elastic sealing material disposed in secured relation at said opening.

43. A unit according to claim 39, said fluid passage valve being a fluid pressurizing valve comprising a soft elastic material having a self-sealing normally self-closed bore.

* * * * *